US007322344B2

(12) United States Patent
Yonezawa

(10) Patent No.: US 7,322,344 B2
(45) Date of Patent: Jan. 29, 2008

(54) FUEL INJECTION CONTROL APPARATUS FOR INTERNAL COMBUSTION ENGINE

(75) Inventor: Koichi Yonezawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 136 days.

(21) Appl. No.: 11/061,443

(22) Filed: Feb. 22, 2005

(65) Prior Publication Data

US 2005/0183698 A1 Aug. 25, 2005

(30) Foreign Application Priority Data

Feb. 24, 2004 (JP) ..... 2004-048317

(51) Int. Cl.
*F02M 37/04* (2006.01)

(52) U.S. Cl. ..... 123/520; 123/305

(58) Field of Classification Search ..... 123/431, 123/516, 518, 519, 520, 357, 299, 300, 305, 123/295; 60/285
See application file for complete search history.

(56) References Cited

U.S. PATENT DOCUMENTS

| | | | | |
|---|---|---|---|---|
| 5,438,967 | A | 8/1995 | Ito | |
| 5,469,832 | A * | 11/1995 | Nemoto | 123/682 |
| 5,619,973 | A * | 4/1997 | Hara et al. | 123/520 |
| 5,699,778 | A * | 12/1997 | Muraguchi et al. | 123/698 |
| 5,924,405 | A * | 7/1999 | Hashimoto | 123/431 |
| 6,079,397 | A * | 6/2000 | Matsumoto et al. | 123/698 |
| 6,089,210 | A * | 7/2000 | Kadowaki | 123/520 |
| 6,325,052 | B1 | 12/2001 | Mashiki | |
| 6,371,086 | B1 * | 4/2002 | Matsubara et al. | 123/500 |
| 6,505,599 | B1 * | 1/2003 | Mashiki et al. | 123/295 |
| 6,659,076 | B2 * | 12/2003 | Kato | 123/305 |
| 6,813,880 | B2 * | 11/2004 | Nishiyama et al. | 60/285 |
| 6,932,068 | B2 * | 8/2005 | Osanai | 123/674 |
| 7,069,903 | B2 * | 7/2006 | Surnilla et al. | 123/339.19 |
| 7,080,626 | B2 * | 7/2006 | Ament et al. | 123/399 |
| 2001/0011540 | A1 | 8/2001 | Mashiki | |
| 2002/0040692 | A1 * | 4/2002 | LaPointe et al. | 123/27 GE |
| 2006/0011165 | A1 * | 1/2006 | Frey et al. | 123/299 |

FOREIGN PATENT DOCUMENTS

| | | |
|---|---|---|
| DE | 103 07 166 A1 | 9/2004 |
| EP | 1 074 729 A2 | 2/2001 |
| EP | 1 357 280 A2 | 10/2003 |
| JP | A 05-231221 | 9/1993 |
| JP | A 10-231758 | 9/1998 |

* cited by examiner

*Primary Examiner*—Carl S. Miller
(74) *Attorney, Agent, or Firm*—Oliff & Berridge, PLC

(57) ABSTRACT

An internal combustion engine includes a direct injector for injecting fuel directly into a combustion chamber of the engine, an intake passage injector for injecting fuel into an intake passage of the engine, and a vaporized fuel processing unit for purging purge gas containing a vaporized fuel into the intake passage. A fuel injection control apparatus includes a detecting section and an injection control section. The detecting section detects the amount of the vaporized fuel in the purge gas. The injection control section changes a fuel injection mode of at least one of the direct injector and the intake passage injector depending on the detected amount of the vaporized fuel. As a result, hampering of engine combustion due to purge gas is suppressed.

20 Claims, 3 Drawing Sheets

FUEL INJECTION CONTROL APPARATUS FOR INTERNAL COMBUSTION ENGINE

BACKGROUND OF THE INVENTION

The present invention relates to fuel injection control apparatuses for an internal combustion engine having an injection control section for controlling a fuel injection mode of a direct injector and that of an intake passage injector.

Conventionally, an engine having an intake passage injector for injecting fuel into an intake passage and a direct injector for injecting fuel directly into a combustion chamber is known (for example, refer to Japanese Laid-Open Patent Publication No. 5-231221). In this engine, the air intake efficiency is improved by, for example, performing fuel injection through the intake passage injector while lowering the temperature in the combustion chamber using the heat of vaporization of the fuel injected by the direct injector.

Also, a vaporized fuel processing unit (for example, Japanese Laid-Open Patent Publication No. 10-231758) is known. The unit includes a fuel adsorption mechanism that adsorbs vaporized fuel produced in a fuel supply system, such as an engine fuel tank. The adsorbed fuel is purged into the intake passage at appropriate timings.

If the aforementioned purging by the vaporized fuel process unit is carried out in the engine having the intake passage injector and the direct injector, the following problem may occur.

More specifically, the fuel injected by the direct injector tends to be distributed in a non-uniform manner in the combustion chamber. That is, for example, the fuel may be distributed relatively dense in the vicinity of a spark plug but relatively scarce in the remaining portion of the combustion chamber. However, the fuel injected by the intake passage injector is vaporized sufficiently before being eventually supplied to the combustion chamber, as compared to the fuel injected by the direct injector. The fuel distribution in this case thus tends to become relatively uniform, as compared to the case of the fuel injected by the direct injector. In other words, in the aforementioned engine, the fuel injected by the direct injector and the fuel injected by the intake passage injector are distributed in the combustion chamber in different manners.

If purging is performed in this engine, it can be assumed that the influence of the purging on the combustion state of the engine may also differ depending on which of the injectors is operated. However, the problem has not been addressed to adequately and an improved fuel injection control apparatus has yet to be developed.

SUMMARY OF THE INVENTION

Accordingly, it is an objective of the present invention to provide a fuel injection control apparatus for an engine including an intake passage injector and a direct injector, capable of suppressing hampering of engine combustion due to purge gas.

To achieve the foregoing and other objectives and in accordance with the purpose of the present invention, the invention provides a fuel injection control apparatus for an internal combustion engine. The engine includes a direct injector for injecting fuel directly into a combustion chamber of the engine, an intake passage injector for injecting fuel into an intake passage of the engine, and a vaporized fuel processing unit for purging purge gas containing a vaporized fuel into the intake passage. The control apparatus includes a detecting section and an injection control section. The detecting section detects the amount of the vaporized fuel in the purge gas. The injection control section changes a fuel injection mode of at least one of the direct injector and the intake passage injector depending on the detected amount of the vaporized fuel.

The present invention provides another fuel injection control apparatus for an internal combustion engine. The engine includes a direct injector for injecting fuel directly into a combustion chamber of the engine, an intake passage injector for injecting fuel into an intake passage of the engine, and a vaporized fuel processing unit for purging purge gas containing a vaporized fuel into the intake passage. The control apparatus includes a determining section and an injection control section. The determining section determines whether or not a condition for enabling the vaporized fuel processing unit to perform the purging into the intake passage is satisfied. The injection control section changes a fuel injection mode of at least one of the direct injector and the intake passage injector when the condition is satisfied.

Further, the present invention provides an internal combustion engine including a direct injector, an intake passage injector, a vaporized fuel processing unit, and a control apparatus. The direct injector injects fuel directly into a combustion chamber of the engine. The intake passage injector injects fuel into an intake passage of the engine. The vaporized fuel processing unit purges a purge gas containing the vaporized fuel into the intake passage. The control apparatus controls a fuel injection mode of the direct injector and the intake passage injector. The apparatus detects the amount of the vaporized fuel in the purge gas and changes the fuel injection mode of at least one of the direct injector and the intake passage injector depending on the detected amount of the vaporized fuel.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described.

Figure 1:
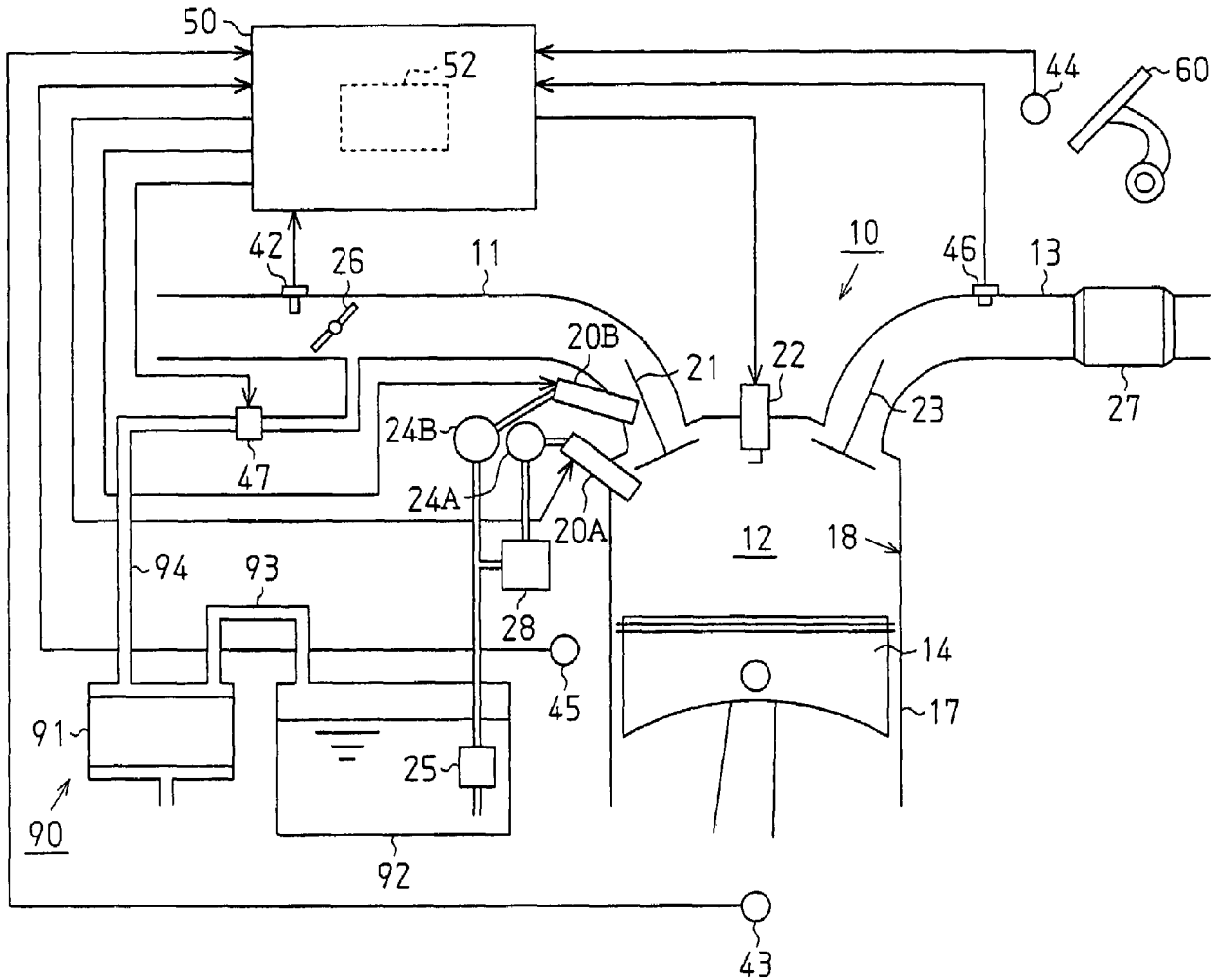
FIG. 1 is a view schematically showing the structure of a fuel injection control apparatus.

An internal combustion engine 10 of the first embodiment has cylinders 17 (only one is shown in FIG. 1). As shown in FIG. 1, an engine piston 14 is received and reciprocates in each cylinder 17. A combustion chamber 12 is defined by a top surface of each piston 14 and an inner wall 18 of the corresponding cylinder 17.

An intake passage 11 and an exhaust passage 13 are connected to the combustion chambers 12. A throttle valve 26 is located in the intake passage 11 and adjusts the amount of the intake air supplied to the combustion chambers 12.

In the engine 10 of the first embodiment, each cylinder 17 is provided with two injectors, a direct injector 20A for injecting fuel directly into the combustion chamber 12 (in-cylinder fuel injection) and an intake passage injector 20B. The intake passage injector 20B injects fuel into a section of the intake passage 11 downstream from the throttle valve 26 (a section of the intake passage 11 closer to the combustion chamber 12), which is the exterior of the combustion chamber 12. The fuel injected by the direct injector 20A is mixed with the air introduced into the combustion chamber 12 through an intake valve 21 in an open state, and an air-fuel mixture is produced. The fuel injected by the intake passage injector 20B is mixed with the intake air in the intake passage 11 and thus forms an air-fuel mixture before being supplied to the combustion chamber 12 through the intake valve 21 in the open state.

The air-fuel mixtures are then exploded and combusted when ignited by a spark plug 22 and discharged from the combustion chamber 12 to the exhaust passage 13 through an exhaust valve 23 in an open state. A catalyst device 27 having an exhaust purifying function is deployed in the exhaust passage 13.

Each set of the direct injectors 20A and the intake passage injectors 20B are connected respectively to a delivery pipe 24A and a delivery pipe 24B. Each of the delivery pipes 24A, 24B supplies fuel of a predetermined pressure to the corresponding set of the injectors 20A, 20B. The delivery pipe 24B, which supplies fuel to the intake passage injectors 20B, is fed with fuel of a predetermined pressure from a fuel tank 92 through a feed pump 25. The delivery pipe 24A, which supplies fuel to the direct injectors 20A, is fed with fuel of a predetermined pressure (higher than the pressure of the delivery pipe 24B) through a high-pressure fuel pump 28. The high-pressure fuel pump 28 further pressurizes the fuel that has been pressurized by the feed pump 25.

In the first embodiment, a vaporized fuel process unit 90 is provided for purging the vaporized fuel produced in the fuel tank 92 to the intake passage 11. The vaporized fuel process unit 90 includes a canister 91 for retaining activated charcoal, which adsorbs vaporized fuel, an introduction passage 93 connecting the canister 91 to the fuel tank 92, and a purge passage 94 connecting the canister 91 to a section of the intake passage 11 downstream from the throttle valve 26. A flow control valve 47 is provided in the purge passage 94 for controlling the amount of the vaporized fuel (the purge gas) introduced from the canister 91 to the intake passage 11.

An electronic control unit (ECU) 50 controls the flow of the purge gas, or performs a purging control procedure. The ECU 50 executes all of the various control procedures for the engine 10, including an air-fuel ratio control procedure and a fuel injection control procedure. The ECU 50 includes a arithmetic section, a drive circuit, and a memory 52 for storing the results obtained from computation in each of the control procedures and the function maps used for such computation. In other words, the ECU 50 forms a fuel injection control section for controlling the fuel injection amount of the direct injectors 20A and that of the intake passage injectors 20B, separately.

The engine 10 also includes various sensors for detecting the operating condition of the engine 10. For example, an intake air amount sensor 42 is disposed in the intake passage 11 at a position upstream from the throttle valve 26 for detecting the intake air amount. An engine rotational speed sensor 43 is arranged in the vicinity of an output shaft (not shown) of the engine 10 for detecting the rotational speed of the engine 10. An accelerator sensor 44 is provided in the vicinity of an accelerator pedal 60 for detecting the depression degree of the accelerator pedal 60. a coolant temperature sensor 45 is secured to a cylinder block (not shown) for detecting the temperature of the engine coolant.

Further, an oxygen sensor 46 is installed in the exhaust passage 13 at a position upstream from the catalyst device 27 for detecting the air-fuel ratio in correspondence with the oxygen concentration of the exhaust. The detection results of the sensors 42 to 46 are sent to the ECU 50. The ECU 50 thus executes the control procedures in accordance with the detection results, depending on the operating condition of the engine 10. Also, the ECU 50 is capable of detecting the concentration of vaporized fuel in the purge gas (hereafter, simply referred to as the vaporized fuel concentration), based on the air-fuel ratio detected in the aforementioned manner. In the illustrated embodiment, the ECU 50 detects the vaporized fuel concentration as an amount correlated to the amount of the fuel contained in the purge gas. In other words, the ECU 50 forms a detecting section for detecting the fuel amount in the purge gas.

As soon as the vaporized fuel process unit 90 starts purging, the ECU 50 starts detection of the vaporized fuel concentration in correspondence with the air-fuel ratio. Based on the detection results obtained in a predetermined time, the ECU 50 learns the vaporized fuel concentration. The learned values are written in the memory 52.

Figure 2:
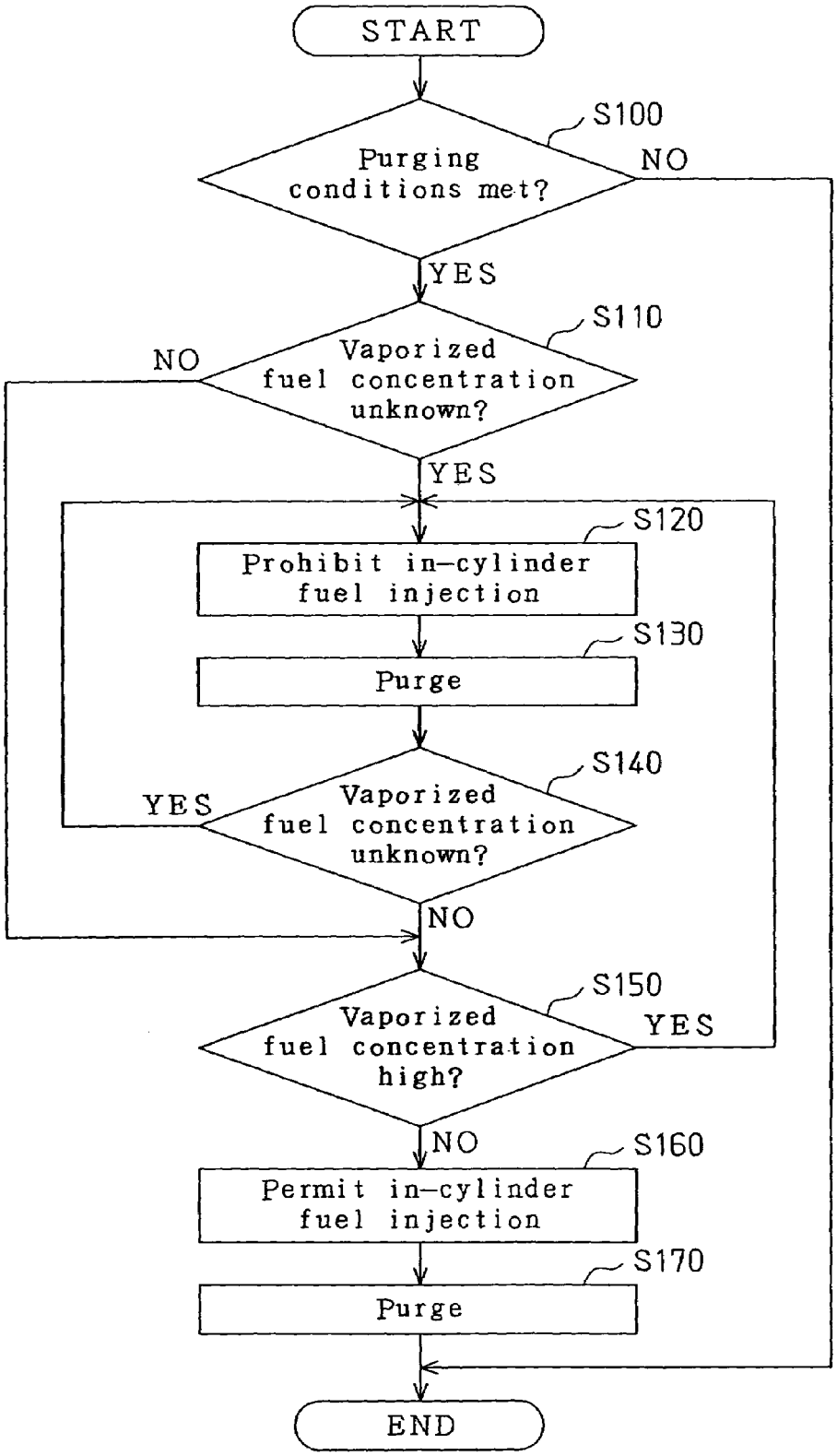
FIG. 2 is a flowchart showing a fuel injection control procedure according to a first embodiment of the present invention.

Next, with reference to FIG. 2, a procedure for controlling fuel injection of the direct injector 20A and purging will be explained. In the first embodiment, the main goal of the fuel injection by the direct injector 20A is to improve the air intake efficiency by cooling the combustion chamber 12 using the heat of vaporization of the fuel injected into the combustion chamber 12 by the direct injector 20A. The flowchart of FIG. 2 indicates the control procedure executed by the ECU 50 repeatedly at predetermined time intervals.

First, in step S100, it is determined whether or not conditions for starting the purging (purging conditions) are satisfied. More specifically, in the illustrated embodiment, the ECU 50 determines that such conditions are met if the engine coolant temperature detected by the coolant temperature sensor 45 is equal to or higher than a predetermined value, the fuel injection by the injectors 20A, 20B is not currently prohibited, or the engine 10 is not currently in a "fuel cut" state, and the operating condition of the engine 10 has been maintained as substantially unchanged for a certain period of time. If one of these conditions is not met, it is indicated that the purging conditions are not satisfied. The ECU 50 forms a determining section for determining whether or not the purging conditions are satisfied.

Two of the conditions regarding the engine coolant temperature and the engine operating condition are set for ensuring that the purging is permitted only if the engine 10 is operating in a relatively stable combustion state. The remaining condition regarding the fuel injection of the injectors 20A, 20B is set for preventing unnecessary fuel supply through the purging if such fuel supply to the engine 10 is undesirable.

If the determination of step S100 is negative, or it is determined that the purging conditions are not met, the control procedure is ended. However, in the case of a positive determination in step S100, the control procedure proceeds to step S110. It is then determined whether or not the vaporized fuel concentration is unknown. In the illustrated embodiment, if learning of the vaporized fuel concentration, or computation of the vaporized fuel concentration, has been completed, it is indicated that the vaporized fuel concentration is known. If the aforementioned learning is incomplete, it is indicated that the learned value is not yet stored in the memory 52 and the vaporized fuel concentration is unknown. In other words, in step S110, it is determined whether or not the learning of the vaporized fuel concentration has been completed.

If the determination of step S110 is positive, or it is determined that the vaporized fuel concentration is unknown, the ECU 50 prohibits the fuel injection by the direct injector 20A, which is the in-cylinder fuel injection, in step S120. More specifically, as long as the vaporized fuel concentration is unknown, it is impossible to accurately determine the amount of the fuel that must be injected by the injectors 20A, 20B for supplying the engine 10 with an amount of fuel suitable for the operating condition of the engine 10. That is, for example, if the fuel injection is performed in correspondence with an amount suitable for the operating condition of the engine 10 in a non-purging state and the purging is executed in this state, the air-fuel ratio in the combustion chamber 12 is enriched correspondingly. In this state, if the vaporized fuel concentration is relatively high, the fuel injection by each direct injector 20A may excessively enrich the air-fuel ratio in the vicinity of the corresponding spark plug 22, which tends to be relatively rich as compared to that of the remaining portion of the combustion chamber 12. This increases the likeliness that rich misfire occurs.

In the first embodiment, since the in-cylinder fuel injection is prohibited in step S120, excessive enrichment of the air-fuel ratio in the vicinity of the spark plugs 22 due to the purge gas is suppressed. In this manner, hampering of the engine combustion such as the rich misfire is avoided. At this stage, the fuel injection amount of the intake passage injectors 20B may be increased for compensating a decrease in the fuel injection amount of the direct injectors 20A, as long as the engine combustion is not hampered. However, such increasing of the fuel injection amount of the intake passage injectors 20B does not necessarily have to be performed.

Subsequently, the purging is performed in step S130. That is, the purging occurs only after the in-cylinder fuel injection is prohibited and the fuel distribution in each combustion chamber 12 becomes relatively uniform. The engine combustion is thus prevented from being hampered by the purging. More specifically, the purging is executed for a predetermined time corresponding to the time for which the flow control valve 47 is maintained in an open state. Following the purging, the aforementioned learning of the vaporized fuel concentration is performed.

At this stage, if the learned value of the vaporized fuel concentration is already stored in the memory 52 (step S140: NO), it is determined whether or not the learned value is higher than a predetermined value in step S150. In contrast, if the determination of step S140 is positive, the procedure returns to step S120. Step S140 may be omitted from the procedure if the learning of the vaporized fuel concentration is completed in a relatively short time and the procedure can proceed to step S150 directly from step S130, in which the purging is performed, without causing any problem.

Further, if the determination of step S110 is negative, the procedure proceeds to step S150, as in the case in which the determination of step S140 is negative.

If the determination of step S150 is positive, or it is determined that the vaporized fuel concentration is higher than the predetermined value (the fuel amount in the purge gas is higher than a predetermined value), the procedure returns to step S120. In other words, the in-cylinder fuel injection is prohibited for suppressing hampering of the engine combustion due to the purge gas.

In contrast, if the determination of step S150 is negative, it is indicated that the influence of the purge gas on the engine combustion is minimum. Thus, in step S160, the in-cylinder fuel injection is permitted. In this state, the fuel injection amount of the direct injectors 20A and that of the intake passage injectors 20B correspond to values at which the engine combustion is maintained in a stable state regardless of introduction of the purge gas of the aforementioned vaporized fuel concentration. Afterwards, the purging is performed in step S170.

The first embodiment has the following advantages.

(1) The purge gas influences the air-fuel ratio in the engine 10 and thus the combustion state of the engine 10. In the first embodiment, the ratio of the fuel injection amount of each direct injector 20A to that of the corresponding intake passage injector 20B is changed in correspondence with the fuel amount in the purge gas. Thus, the aforementioned influence of the purge gas on the engine 10 is suppressed, and the engine combustion state is maintained advantageously.

(2) In the first embodiment, the vaporized fuel concentration is detected as an amount correlated to the fuel amount in the purge gas. Since the amount of the fuel adsorbed by the fuel adsorbing portion of the vaporized fuel process unit 90 is varied, the adverse influence of the purge gas on the engine combustion tends to be severe. However, in the illustrated embodiment, the vaporized fuel concentration is detected and the fuel injection amount ratio between the injectors 20A, 20B is changed in correspondence with the detection result. The adverse influence of the purge gas is thus effectively suppressed.

(3) In the first embodiment, only if the detected vaporized fuel concentration is higher than the predetermined value, the fuel injection amount ratio is changed such that the fuel injection amount of the direct injector 20A is decreased. In this manner, hampering of the engine combustion is suppressed. Further, if the influence of the purge gas is minimum, controlling of the fuel injection amount suitable for a normal engine combustion state may be performed.

(4) In the first embodiment, learning of the vaporized fuel concentration is executed in accordance with detection results obtained in a predetermined time. Also, the fuel injection amount ratio is changed when such learning is incomplete.

More specifically, if the learning of the vaporized fuel concentration is incomplete and the vaporized fuel concentration is not known, it is indicated that the extent of the adverse influence of the purge gas on the engine combustion state is also unknown. Thus, in the first embodiment, by changing the fuel injection amount ratio in this state, the influence of the purge gas is further reliably suppressed.

(5) The fuel injected by the direct injectors 20A is not sufficiently vaporized as compared to the fuel injected by the intake passage injectors 20B. The fuel injected by each direct injector 20A thus tends to be distributed in a non-uniform manner in the combustion chamber 12. However, in the first embodiment, since the fuel injection amount ratio is changed such that the portion corresponding to the direct injector 20A is decreased, formation of a limited area with an excessively high fuel concentration in the combustion chamber 12 due to the non-uniform fuel distribution is prevented from occurring. Therefore, aggravation of exhaust properties caused by incomplete combustion is also suppressed.

As an alternative method to the first embodiment, the fuel injection amount ratio may be changed such that the portion corresponding to the intake passage injector 20B is decreased, if, for example, the detected fuel amount in the purge gas exceeds a predetermined amount. In this case, the adverse influence of the purge gas can be suppressed by preventing the total of the fuel injection amount of the intake passage injector 20B and the fuel amount in the purge gas, or the total amount of the fuel fed from the intake passage 11 to the combustion chamber 12, from becoming excessively large.

However, in this case, if the detection result of the fuel amount in the purge gas (the learned value or the like) is not sufficiently reliable, or, for example, if the detection result exceeds the actual fuel amount, the fuel injection amount of the intake passage injectors 20B may be set to a relatively small value, such that the actual total amount of the fuel fed from the intake passage 11 to the combustion chambers 12 is excessively decreased. The fuel fed from the intake passage 11 to the combustion chambers 12 is vaporized sufficiently, as compared to the fuel injected directly into the combustion chambers 12 by the direct injectors 20A. Thus, for stabilizing the engine combustion, it is desirable that the excessive decrease of the total amount of the fuel fed from the intake passage 11 to the combustion chambers 12 is avoided.

However, in the illustrated embodiment, the fuel injection amount ratio is changed such that the portion corresponding to the direct injectors 20A is decreased. Thus, while the intake passage injectors 20B are allowed to inject a sufficient amount of fuel, which is vaporized sufficiently, formation of the limited area with the excessively high fuel concentration in each combustion chamber 12 is suppressed. Thus, aggravation of the exhaust properties due to incomplete combustion is effectively suppressed.

(6) In the first embodiment, the fuel injection by the direct injectors 20A is suspended (the corresponding fuel injection amount is set to zero) when the fuel injection amount ratio is to be changed. In this manner, the non-uniform fuel distribution is quickly corrected.

(7) Before the determination whether or not the vaporized fuel concentration is unknown (step S110), it is determined whether or not the purging conditions are met (step S100). If the conditions are not met, the fuel injection amount ratio is not changed. As has been described, the purge gas introduced into the combustion chambers 12 influences the combustion state of the engine 10. However, in the first embodiment, since the fuel injection amount ratio is not changed unless the purging conditions are met, the influence of changes in the fuel injection amount ratio, which would otherwise be caused by purging, is reliably avoided. The combustion of the engine 10 is thus maintained advantageously.

Second Embodiment

In a second embodiment of the present invention, unlike the first embodiment, the in-cylinder fuel injection is prohibited regardless of whether or not the vaporized fuel concentration is unknown, if the purging conditions are satisfied.

Figure 3:
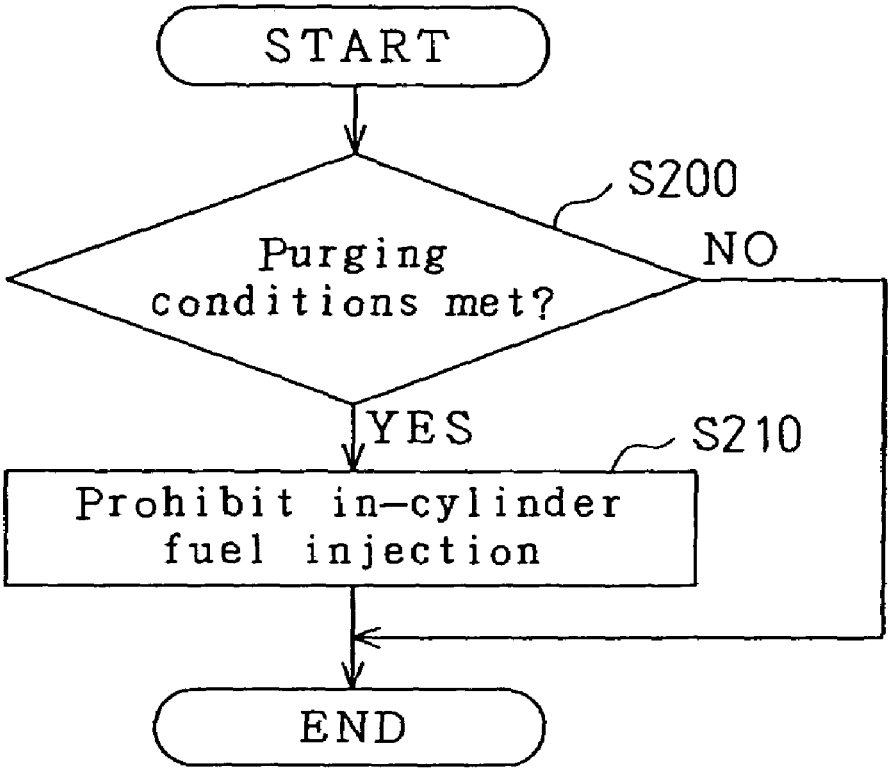
FIG. 3 is a flowchart showing a fuel injection control procedure according to a second embodiment of the present invention.

More specifically, as indicated by the flowchart of FIG. 3, it is determined whether or not the purging conditions are met in step S200. The determination corresponds to that of step S100 of the first embodiment. In the second embodiment, if the determination of step S200 is positive, the procedure proceeds to step S210 and the in-cylinder fuel injection is prohibited. Step S210 corresponds to step S120 of the first embodiment. Thus, if the in-cylinder fuel injection is being performed at this point, the fuel injection amount of the direct injectors 20A is changed to zero, such that the fuel injection amount ratio between the direct injectors 20A and the intake passage injectors 20B is changed. On completion of step S210, the procedure is ended.

In contrast, if the determination of step S200 is negative, the procedure is suspended without performing step S210. If the determination of step S200 is positive, the purging may be performed following completion of step S210, or when a different purging condition other than the above-described ones is satisfied.

The second embodiment has the following advantage in addition to those described in the items (5) and (6) for the first embodiment.

(8) In the second embodiment, it is determined whether or not the purging conditions are met. The fuel injection amount ratio is changed only if these conditions are satisfied. In this manner, the influence of the purge gas on the combustion state of the engine 10 is suppressed. The engine combustion is thus maintained advantageously.

The present invention is not restricted to the above description but may be embodied in the following modified forms.

In the illustrated embodiments, the fuel injection by the direct injectors 20A is suspended, or the fuel injection amount of the direct injector 20A is set to zero, in step S120 or S210. However, the fuel injection amount of the direct injectors 20A does not necessarily have to be zero but may be decreased to a different level than zero.

In the first embodiment, the air-fuel ratio detected by the oxygen sensor 46 is used for detecting the vaporized fuel concentration. However, a hydrocarbon (HC) sensor may be deployed in the canister 91 or the fuel tank 92, for example, and the vaporized fuel concentration may be detected by means of the HC sensor. Alternatively, it may be determined that the vaporized fuel concentration is relatively high when the combustion of the engine 10 is hampered by execution of the purging.

In the first embodiment, the vaporized fuel concentration is learned. However, the determination whether or not to change the fuel injection amount ratio may be carried out with reference to detection result of the vaporized fuel concentration, without learning the vaporized fuel concentration.

The fuel injection amount ratio may be changed such that the portion corresponding to the intake passage injectors 20B is decreased. In this case, by preventing the total of the fuel injection amount of the intake passage injectors 20B and the fuel amount in the purge gas from becoming excessively large, the adverse influence of the purge gas on the engine 10 is suppressed. Further, as long as the combustion of the engine 10 is not hampered, the fuel injection amount of the direct injectors 20A may be increased for compensating a decrease of the fuel supply amount for the combustion chambers 12. If such compensation is unnecessary, the fuel injection amount of the direct injectors 20A may be decreased or maintained.

In the illustrated embodiments, hampering of the engine combustion is suppressed by changing the fuel injection amount ratio. However, the fuel injection pressure of the direct injectors 20A may be raised such that hampering of the engine combustion is suppressed. In this case, the fuel injection pressure of the direct injectors 20A is controlled by, for example, adjusting the displacement of the high-pressure fuel pump 28 by means of the ECU 50.

More specifically, in this case, step S120 of the first embodiment may be replaced by the step of "increasing the fuel injection pressure of the direct injectors 20A". Step S160 may be replaced by the step of "returning the fuel injection pressure of the direct injectors 20A to the state before execution of step S120". Further, in the second embodiment, step S210 may be replaced by the step of "increasing the fuel injection pressure of the direct injectors 20A".

In these cases, vaporization of the fuel in the combustion chambers 12 is promoted by the raised fuel injection pressure of the direct injectors 20A. Accordingly, the above-described non-uniform fuel distribution in the combustion chambers 12 is suppressed. The adverse influence of the purge gas on the air-fuel ratio is thus suppressed and the engine combustion is maintained advantageously.

Also, hampering of the engine combustion due to the purge gas may be suppressed by changing both of the fuel injection amount ratio and the fuel injection pressure of the direct injectors 20A.

The present examples and embodiments are to be considered as illustrative and not restrictive and the invention is not to be limited to the details given herein, but may be modified within the scope and equivalence of the appended claims.

The invention claimed is:

1. A fuel injection control apparatus for an internal combustion engine, the engine including a direct injector for injecting fuel directly into a combustion chamber of the engine, an intake passage injector for injecting fuel into an intake passage of the engine, and a vaporized fuel processing unit for purging purge gas containing a vaporized fuel into the intake passage, the control apparatus comprising:

a detecting section for detecting the amount of the vaporized fuel in the purge gas; and an injection control section for changing a fuel injection mode of at least one of the direct injector and the intake passage injector depending on the detected amount of the vaporized fuel.

2. The apparatus according to claim 1, wherein the detecting section detects a concentration of the vaporized fuel in the purge gas as a value correlated to the amount of the vaporized fuel.

3. The apparatus according to claim 1, wherein the injection control section changes the fuel injection mode if the amount of the vaporized fuel exceeds a predetermined level.

4. The apparatus according to claim 1, wherein the detecting section learns the amount of the vaporized fuel based on the detection results of the amount of the vaporized fuel obtained in a predetermined time period, and wherein the injection control section changes the fuel injection mode when such learning is incomplete.

5. The apparatus according to claim 1, wherein changing of the fuel injection mode includes changing the ratio of the fuel injection amount between the direct injector and the intake passage injector.

6. The apparatus according to claim 5, wherein the changing of the ratio of the fuel injection amount includes decreasing a portion of the fuel injection amount that corresponds to the direct injector.

7. The apparatus according to claim 6, wherein the decreasing of the portion of the fuel injection amount that corresponds to the direct injector includes suspending the fuel injection by the direct injector.

8. The apparatus according to claim 1, wherein the changing of the fuel injection mode includes raising the fuel injection pressure of the direct injector.

9. A fuel injection control apparatus for an internal combustion engine, the engine including a direct injector for injecting fuel directly into a combustion chamber of the engine, an intake passage injector for injecting fuel into an intake passage of the engine, and a vaporized fuel processing unit including a canister for purging purge gas containing a vaporized fuel into the intake passage, the control apparatus comprising:

a determining section for determining whether or not a condition for enabling the vaporized fuel processing unit to perform the purging into the intake passage via the canister is satisfied, the condition including at least one of whether an engine coolant temperature is equal to or higher than a predetermined value, whether fuel injection by the direct injector and the intake passage injector is not currently prohibited, and whether an operating condition of the engine has been maintained as substantially unchanged for a predetermined period of time; and an injection control section for changing a fuel injection mode of at least one of the direct injector and the intake passage injector when the condition is satisfied.

10. A fuel injection control apparatus for an internal combustion engine, the engine including a direct injector for injecting fuel directly into a combustion chamber of the engine, an intake passage injector for injecting fuel into an intake passage of the engine, and a vaporized fuel processing unit for purging purge gas containing a vaporized fuel into the intake passage, the control apparatus comprising:

a determining section for determining whether or not a condition for enabling the vaporized fuel processing unit to perform the purging into the intake passage is satisfied; and an injection control section for changing a fuel injection mode of at least one of the direct injector and the intake passage injector when the condition is satisfied, wherein changing of the fuel injection mode includes changing the ratio of the fuel injection amount between the direct injector and the intake passage injector.

11. The apparatus according to claim 10, wherein the changing of the ratio of the fuel injection amount includes decreasing a portion of the fuel injection amount that corresponds to the direct injector.

12. The apparatus according to claim 11, wherein the decreasing of the portion of the fuel injection amount that corresponds to the direct injector includes suspending the fuel injection by the direct injector.

13. A fuel injection control apparatus for an internal combustion engine, the engine including a direct injector for injecting fuel directly into a combustion chamber of the engine, an intake passage injector for injecting fuel into an intake passage of the engine, and a vaporized fuel processing unit for purging purge gas containing a vaporized fuel into the intake passage, the control apparatus comprising:

a determining section for determining whether or not a condition for enabling the vaporized fuel processing unit to perform the purging into the intake passage is satisfied; and an injection control section for changing a fuel injection mode of at least one of the direct injector and the intake passage injector when the condition is satisfied, wherein the changing of the fuel injection mode includes raising the fuel injection pressure of the direct injector.

14. An internal combustion engine comprising:

a direct injector for injecting fuel directly into a combustion chamber of the engine;

an intake passage injector for injecting fuel into an intake passage of the engine;

a vaporized fuel processing unit for purging a purge gas containing the vaporized fuel into the intake passage; and a control apparatus for controlling a fuel injection mode of the direct injector and the intake passage injector, wherein the apparatus detects the amount of the vaporized fuel in the purge gas and changes the fuel injection mode of at least one of the direct injector and the intake passage injector depending on the detected amount of the vaporized fuel.

15. The engine according to claim 14, wherein the control apparatus detects a concentration of the vaporized fuel in the purge gas as a value correlated to the amount of the vaporized fuel.

16. The engine according to claim 14, wherein the control apparatus changes the fuel injection mode if the amount of the vaporized fuel exceeds a predetermined level.

17. The engine according to claim 14, wherein the control apparatus learns the amount of the vaporized fuel based on the detection results of the amount of the vaporized fuel obtained in a predetermined time period, and changes the fuel injection mode when such learning is incomplete.

18. The engine according to claim 14, wherein changing of the fuel injection mode includes changing the ratio of the fuel injection amount between the direct injector and the intake passage injector.

19. The engine according to claim 18, wherein the changing of the ratio of the fuel injection amount includes decreasing a portion of the fuel injection amount that corresponds to the direct injector.

20. The engine according to claim 14, wherein the changing of the fuel injection mode includes raising the fuel injection pressure of the direct injector.

* * * * *